US012760537B2

(12) United States Patent
Penzel et al.

(10) Patent No.: US 12,760,537 B2
(45) Date of Patent: Oct. 13, 2026

(54) WORK PLATFORM FOR WORKING ON A ROOF AREA OF A VEHICLE, PARTICULARLY ON A ROOF AREA OF AN ELECTRIFIED VEHICLE, AND MAINTENANCE DEVICE HAVING AT LEAST ONE SUCH WORK PLATFORM

(71) Applicant: PENZEL VALIER AG, Zürich (CH)

(72) Inventors: Christian Penzel, Zürich (CH); Martin Valier, Chur (CH)

(73) Assignee: PENZEL VALIER AG, Zurich (CH)

( * ) Notice: Subject to any disclaimer, the term of this patent is extended or adjusted under 35 U.S.C. 154(b) by 872 days.

(21) Appl. No.: 18/175,615

(22) Filed: Feb. 28, 2023

(65) Prior Publication Data

US 2023/0279675 A1 Sep. 7, 2023

(30) Foreign Application Priority Data

Mar. 1, 2022 (EP) ..... 22159524

(51) Int. Cl.
*E04G 1/15* (2006.01)
*E04G 5/14* (2006.01)
*B61K 13/00* (2006.01)

(52) U.S. Cl.
CPC ..... *E04G 1/15* (2013.01); *E04G 5/14* (2013.01); *B61K 13/00* (2013.01); *E04G 2001/157* (2013.01)

(58) Field of Classification Search
CPC ..... E04G 1/15; E04G 5/14; E04G 2001/157; E04G 3/26; E04G 3/28; E04G 1/36;
(Continued)

(56) References Cited

U.S. PATENT DOCUMENTS 7,140,467 B2 * 11/2006 Cook ..... B60R 3/005 182/141
8,015,647 B2 * 9/2011 Bennett ..... B65G 69/22 14/71.1

(Continued)

FOREIGN PATENT DOCUMENTS

AU 2011100718 A4 7/2011
CN 108482424 A * 9/2018 ..... B61L 23/007

(Continued)

OTHER PUBLICATIONS

CN-108482424-A (Year: 2018).*

(Continued)

*Primary Examiner* — David E Martinez
(74) *Attorney, Agent, or Firm* — Wentsler LLC

(57) ABSTRACT

A work platform for working on a roof area of an electrified vehicle, including a platform. The platform has first platform elements, which form a work plane, and in each case have a longitudinal extent within each case two mutually opposite long sides, and a plurality of second platform elements, which are arranged along at least one of the long sides of the first platform elements and can be transferred between two positions with respect to the first platform elements. The second platform elements form a fall protection device in a first position and a continuation of the work plane of the first platform elements in a second position. Furthermore, a maintenance device having at least one such work platform.

20 Claims, 7 Drawing Sheets

(58) Field of Classification Search
CPC .. E04G 5/08; B61K 13/00; B60S 5/00; B60R 3/005; B60P 3/226; B65G 69/24; B65G 69/26
See application file for complete search history.

(56) References Cited

U.S. PATENT DOCUMENTS

| | | | | |
|---|---|---|---|---|
| 8,051,951 | B2 | 11/2011 | Bennett et al. | |
| 8,479,882 | B2 * | 7/2013 | DuBose | B60P 1/00 182/113 |
| 10,087,641 | B2 * | 10/2018 | Harmon | B66F 11/04 |
| 11,512,477 | B2 * | 11/2022 | Restivo | E04G 5/14 |
| 12,202,688 | B2 * | 1/2025 | Honeycutt | B65G 67/02 |
| 2017/0305396 | A1 * | 10/2017 | Shiratsuchi | B61L 23/14 |

FOREIGN PATENT DOCUMENTS

| | | | | |
|---|---|---|---|---|
| CN | 208411754 U | * | 1/2019 | |
| CN | 110817759 A | * | 2/2020 | B66F 11/042 |
| CN | 112061173 A | * | 12/2020 | B61K 13/00 |
| DE | 20 2004 011 076 U1 | | 11/2004 | |
| EP | 1 441 089 A1 | | 7/2004 | |
| KR | 20170118404 A | * | 10/2017 | F15B 15/14 |
| KR | 10-2126326 B1 | | 7/2020 | |
| RU | 176 334 U1 | | 1/2018 | |
| RU | 206 581 U1 | | 9/2021 | |
| RU | 208 450 U1 | | 12/2021 | |

OTHER PUBLICATIONS

CN-110817759-A (Year: 2020).*
CN-112061173-A (Year: 2020).*
CN-208411754-U (Year: 2019).*
KR-20170118404-A (Year: 2017).*
European Search Report dated Jul. 21, 2023 for corresponding European Application No. 23159207.2.
European Search Report dated Aug. 17, 2022 for corresponding European Application No. 22159524.2.

* cited by examiner

WORK PLATFORM FOR WORKING ON A ROOF AREA OF A VEHICLE, PARTICULARLY ON A ROOF AREA OF AN ELECTRIFIED VEHICLE, AND MAINTENANCE DEVICE HAVING AT LEAST ONE SUCH WORK PLATFORM

CROSS-REFERENCE TO RELATED APPLICATIONS

This application claims the benefit of priority to European Application No. EP22159524.2, filed on Mar. 1, 2022, the entire disclosure of which is hereby incorporated herein by reference.

The present invention relates to a work platform for working on a roof area of a vehicle, particularly on a roof area of an electrified vehicle, according to the claims and also a maintenance device having at least one work platform according to the claims.

TECHNICAL BACKGROUND

Work also takes place on vehicles time and again on the roof area, whether for new installations or for maintenance work. Especially in the case of means of transport or lorries, this work is executed at a height of several metres above the ground. Therefore, safety measures are necessary, in order to substantially reduce the danger of falling for workers when carrying out work.

In the case of electrified vehicles, current-carrying parts, such as current collectors, are provided on the roof area. As long as current flows, the possibility that a worker may come into contact with any of these current-carrying parts must be prevented. The voltage for such vehicles may be more than 10 000 V, so contact with the current-carrying parts will have very severe consequences.

Work platforms for working on the roof area of a vehicle are known from the prior art, which have a guard rail as fall protection device and as protection from current-carrying components.

For example, AU2011100718A4 shows a work platform with two work areas. The platform of the work platform has stationary platform elements, which form a work plane and in each case have a longitudinal extent with two mutually opposite long sides. A guard rail runs along these long sides in each case as fall protection and as protection from current-carrying components. Furthermore, a plurality of movable platform elements are provided, which are arranged below the stationary platform elements and, after a vehicle drives in, can be moved out of this first position parallel to these stationary platform elements in the direction of the vehicle (second position). In the extended state, the guard rail is set back from the free edge of the movable platform elements. After ensuring that current is no longer flowing, individual gates are unlocked in the guard rail, so that the worker can reach the roof area of the vehicle.

A disadvantage of this known solution is that the guard rail hinders free working on the work plane.

A work platform with a work area is known from KR102126326B1, wherein the platform of the work platform has a stationary platform element. A guard rail runs in each case along the long sides of the stationary platform element as fall protection device and as protection from current-carrying components. One of the guard rails has open sections, which allow access, area by area, to the work area in a closable manner. A movable platform element is provided in the region of the access, which platform element is arranged below the stationary platform element and, after a vehicle drives in, can be moved out of this first position parallel to these stationary platform elements in the direction of the vehicle (second position). In the extended state, the guard rail is set back from the free edge of the movable platform element. After ensuring that current is no longer flowing, access is unlocked in the guard rail, so that the worker can reach a limited section of the roof area of the vehicle.

A disadvantage of this known solution is that the guard rail likewise hinders free working on the work plane. Furthermore, only a very limited area is available to the worker in this solution for working on the roof area of the vehicle. In addition, to the side of the extended second platform element, there is no protection against the falling of the worker nor from falling tools.

RU176334U1 shows a work platform having a pivotable walkway, which is arranged on a stationary platform element. In the state in which it is pivoted down, the walkway allows maintenance work on the front region of a vehicle which is driven in.

A disadvantage of this known solution is that maintenance work is not possible on the entire roof area of the vehicle.

Furthermore, it is known from the generic prior art to provide removable guard rails on a work platform, which can be removed and arranged again as required.

A disadvantage of this known solution is that the disassembly and assembly of the guard rails are complex and time-intensive. In addition, there is the danger that a guard rail is disassembled before the current is switched off or so long as there is still a potential danger of falling for the workers.

DESCRIPTION OF THE INVENTION

It is the object of the invention to create a generic work platform and a generic maintenance device which do not have at least one of the aforementioned disadvantages and in particular enable efficient and safe working on a roof area of a vehicle.

These objects are achieved by the features of the independent patent claims. Advantageous developments of the invention are specified in the dependent patent claims.

The work platform according to the invention for working on a roof area of a vehicle, particularly on a roof area of an electrified vehicle, comprises at least one platform, the at least one platform having at least one first platform element, which forms a work plane, and a longitudinal extent with two mutually opposite long sides, and having at least one second platform element, which is arranged along at least one of the long sides of the at least one first platform element and can be transferred between two positions with respect to the at least one first platform element. The at least one second platform element forms a fall protection device in a first position and a continuation of the work plane of the at least one first platform element in a second position.

In the first position, the at least one second platform element is aligned transversely to the work plane spanned by the at least one first platform element. In this first position, the at least one second platform element constitutes the fall protection device and at the same time prevents contact of the workers located on the at least one first platform element with current-carrying components, analogously to a guard rail.

The dimension of the at least one second platform element is preferably chosen such that the same corresponds to the relevant standards transversely to the work plane. For example, in the case of low-voltage current, a dimension is sufficient, which corresponds to a guard rail height of at least 1.10 m. By contrast, in the case of high-voltage current, a dimension of the at least one second platform element is required, which corresponds to a guard rail height of at least 1.80 m.

Particularly advantageously, the at least one second platform element is aligned substantially perpendicularly to this work plane in the first position, which gives workers a high feeling of safety.

As long as the current-carrying components are still live and/or there is a danger of falling for the workers, the at least one second platform element is left in the first position. Only when it is ensured that both of these aforementioned dangers no longer exist is the at least one second platform element transferred to its second position.

As in the second position, the at least one second platform element forms a continuation of the work plane of the at least one first platform element, the entire work plane is available to the workers, wherein no constructive safety device restricts the work area around the roof area of the vehicle.

A control is advantageously provided, which enables a controlled transfer of the at least one second platform element from the first position into the other position. For example, electric, pneumatic or hydraulic means are also provided for this. This control is further advantageously designed such that transfer of the at least one second platform element only takes place if there is no danger for workers located on or below the platform due to this process.

Preferably, the at least one second platform element is arranged in a pivotable manner on the at least one first platform element, which allows a simple design configuration for targeted transfer of the at least one second platform element between the two positions.

Preferably, the at least one second platform element is constructed in a multipart manner, wherein one of the platform element parts can be transferred between two positions with respect to a different platform element part. Thus, a fall protection device can for example be realized, which can fulfil the standards in the case of low-voltage current and also in the case of high-voltage current. Furthermore, in the case of a maintenance system with high-voltage current, the space requirement of the at least one second platform element in the second position can be reduced, for example by folding up the platform element parts.

Preferably, the at least one second platform element has at least one free end, wherein at least one distance bridging device is provided in the region of the free end of the at least one second platform element for at least partial bridging of a distance between the free end of the at least one second platform element and a vehicle located in the work platform. With the at least one distance bridging device, it is possible to ensure that the at least one second platform element can be transferred from the one position into the other position without risk of damaging the positioned vehicle and at the same time, a gap present between the free end of the at least one second platform element is reduced to a tolerable size or closed completely. As a result, it is possible in particular to prevent work equipment, such as tools in particular, from being able to fall inadvertently through the gap, which could lead to damage to the vehicle or injure workers located below the work platform.

Advantageously, at least one compression section is provided at a free end of the at least one distance bridging device, which compression section deforms in the event of contact with an outer side of the vehicle, as a result of which damage to the vehicle in the event of any contact of the at least one advanced distance bridging device with the outer side of the vehicle is prevented. In addition, using at least one such compression section, unevennesses which are for example present on the outer side of the vehicle can be compensated.

The at least one distance bridging device can advantageously be moved between its positions in a controlled manner. The at least one distance bridging device is further advantageously spring-loaded, wherein the spring force particularly advantageously acts in one direction on the at least one distance bridging device such that the same is forced by means of the spring force into a park position. The advancing device for advancing the at least one distance bridging device is designed in such a manner in this case that the same can overcome the spring force.

Preferably, the at least one distance bridging device has a plurality of spacer elements which can be moved parallel to one another, using which the gap to the outer side of the vehicle can easily be reduced, in a manner adapted to the contour of this outer side, or closed.

Advantageously, the plurality of spacer elements which can be moved parallel to one another can be transferred separately from one another in a controllable manner between a park position and a distance bridging position, which facilitates an exact positioning of the same.

Further preferably, the plurality of spacer elements which can be moved parallel to one another are spring-loaded, wherein the spring force particularly advantageously acts on the movable spacer elements in one direction, such that the same are forced into their park position. The advancing device or advancing devices for advancing the plurality of spacer elements which can be moved parallel to one another are designed in such a manner in this case that the same can overcome the corresponding spring force.

Preferably, a plurality of second platform elements are provided along at least one long side of the at least one first platform element, with which the elements of the work platform can easily be adapted to the corresponding length of the vehicle.

Advantageously, each of the second platform elements can be transferred between two positions independently of the other second platform elements, which additionally simplifies the adaptability of the work platform, e.g. to the effective length of the vehicle.

Preferably, at least two first platform elements are provided, which are spaced from one another with the formation of an accommodating region for accommodating the vehicle between the two first platform elements, wherein the second platform elements of the two first platform elements are respectively arranged on the long side of the same, which sides face one another. If the second platform elements are in each case located in the second position, the roof area of the vehicle is accessible from both sides. If the second platform elements are in each case located in the first position, the workers can safely move on both sides of the work area.

Preferably, the first platform element has at least one second platform element respectively on both of its long sides between two accommodating regions for the vehicles, wherein each at least one second platform element on one long side of the first platform element can be transferred from the first position to the second position independently of the other at least one second platform element on the other long side of the first platform element. Thus, the space requirement for a work platform with a plurality of accommodating regions can be considerably reduced or optimized.

Preferably, at least two closing elements are provided on each first platform element as second platform elements, wherein the at least two closing elements are formed in the second position for end-face closure of the accommodating region. The at least two closing elements safeguard the workers against a fall in particular in the region of the front side or the front contour and the rear side or the rear contour of the vehicle.

Advantageously, in each case a further distance bridging device is provided on these closing elements, using which even in these regions a gap between the corresponding free ends and the outer side of the vehicle can be reduced or closed. The further distance bridging device is for example constructed like the at least one distance bridging device on the free end of the second platform elements.

Preferably, at least one closing element has a front element, which can be transferred from a park position to a work position, using which, if required, a larger distance can be overcome in the second position with the closing element, but the closing element can also be arranged anywhere between the ends of the at least one first platform element, which enables the use of the work platform for different vehicle lengths.

Advantageously, the front element is arranged in a pivotable manner, which allows a simple design configuration for targeted transfer of the front element between the two positions.

Preferably, at least one fall protection element is arranged on at least one of the second platform elements, in order to also ensure fall protection transversely to the long side of the at least one first platform element.

Advantageously, the at least one fall protection element can be transferred from a storage position into a safety position, so that the same can be positioned as required, but does not hinder or limit the positioning of the at least one second platform elements and/or the at least one closing elements.

Further advantageously, the at least one fall protection element is arranged in a pivotable manner on the at least one of the second platform elements, which allows a simple design configuration for targeted transfer of the at least one fall protection element between the two positions.

Preferably, a position detection device is provided for detecting the position of a vehicle in the work platform, which makes it possible for the control or the operator of the work platform to transfer or order the transfer, in accordance with the detected position of the vehicle, of at least one of the at least one second platform elements from the first position to the second position. The position detection device comprises sensors for example, such as for example one or more light curtains.

Advantageously, the position detection device is designed such that the type or the model of the vehicle located in the work platform is detected. For example, the distance bridging device is moved by the control on the basis of a database, in which the dimensions of various vehicles are stored, which allows fast adjustment and additionally reduces the danger of damage.

Preferably, a positioning device is provided for positioning the vehicle along the work platform, which for example makes it possible for the driver of the vehicle to position their vehicle correctly. For example, the driver receives a visual instruction to continue to drive the vehicle forwards, to stop the vehicle or to reverse the vehicle. The display of the positioning device may have sensors and may further advantageously be constructed analogously to a display of a car wash, which is generally known to the person skilled in the art.

Preferably, at least one work plane safety device is provided for detecting objects and people on the work plane, which ensures that no objects and people are present prior to transferring one of the elements or a part of the work platform. Thus, the danger of accidents is reduced considerably.

Advantageously, the at least one work plane safety device comprises a scanner, particularly a laser scanner. The use of a rotary scanner has proven particularly preferred for this.

Alternatively or additionally, the work plane safety device comprises a thermal scanner, particularly a thermal imaging camera, for thermally monitoring the work plane. Therefore, people can be detected easily, who are still located in the roof area of the vehicle, even if these people are located e.g. behind a roof superstructure element. Particularly advantageously, a thermal scanner of this type is arranged in such a manner that it is located above the roof area of the vehicle—when the vehicle has been driven in.

The maintenance device according to the invention for working on roof areas of vehicles, particularly on roof areas of electrified vehicles, comprises at least one work platform which has at least a portion of the previously mentioned features.

DESCRIPTION OF THE FIGURES

The invention is explained in more detail on the basis of exemplary embodiments by means of the following figures. The reference list is part of the disclosure.

Position details, such as "top", "bottom", "right" or "left" in each case relate to the corresponding illustrations and are not to be understood as limiting.

The figures are described in a cohesive and comprehensive manner. The same reference numbers denote the same components. In the figures

IMPLEMENTATION OF THE INVENTION

In the following, the drawings respectively show electrified rail vehicles. However, the invention is not limited to this type of vehicle, but rather can also be used for working on the roof area of any other vehicles, such as for example lorries, buses, motor homes, wherein this list is not exhaustive.

Figure 1:
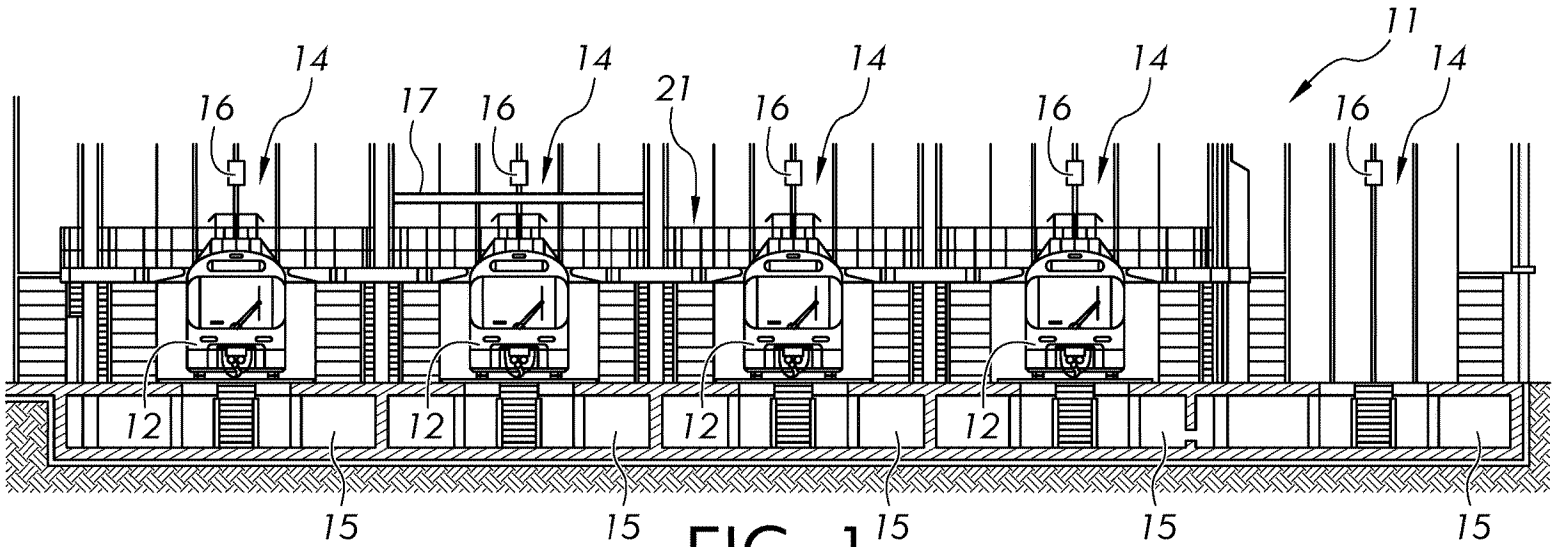
FIG. 1 shows a maintenance device according to the invention for vehicle maintenance having a work platform according to the invention in cross section.

The maintenance device 11 shown in FIG. 1 for maintaining electrified rail vehicles 12, e.g. locomotives, multiple units, trams, etc. has a work platform 21 according to the invention for working on the roof area of the vehicles 12. In this example, five work areas 14 are available, using which it is possible to work on up to five vehicles 12 at the same time. Each work area 14 has an inspection pit 15 for working below the vehicle 12. In a region above the vehicle 12, a top power rail 16 is provided for each work area 14, which top power rail can be folded upwards after the positioning of the corresponding vehicle 12 in the maintenance device 11. After the completion of the maintenance work, the corresponding top power rail 16 is folded down again and the vehicle 12 can leave the maintenance system 11 again. Each work area 14 may additionally have a movable overhead travelling crane 17.

Figure 2:
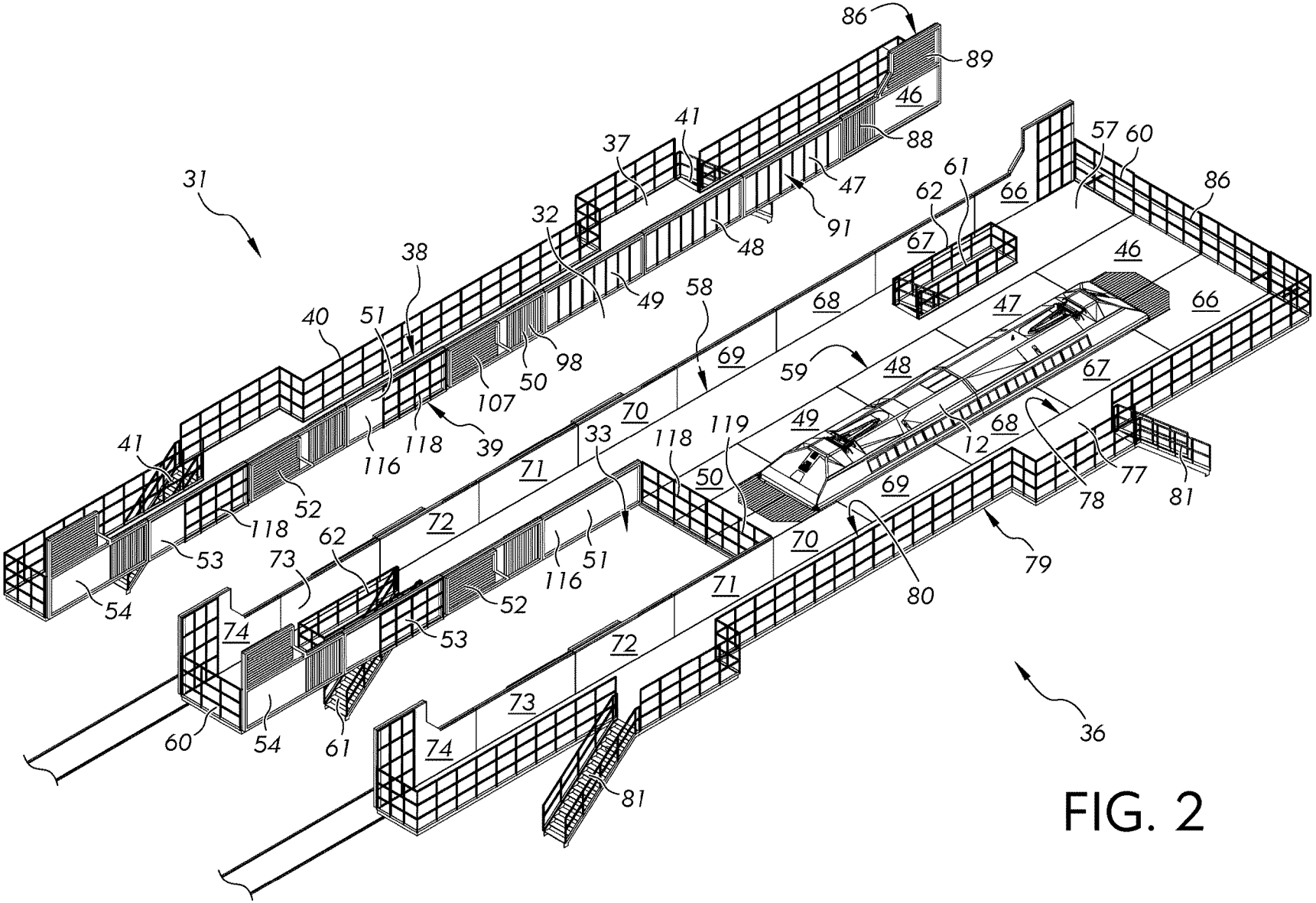
FIG. 2 shows a work platform according to the invention having two work areas in a perspective plan view.
Figure 3:
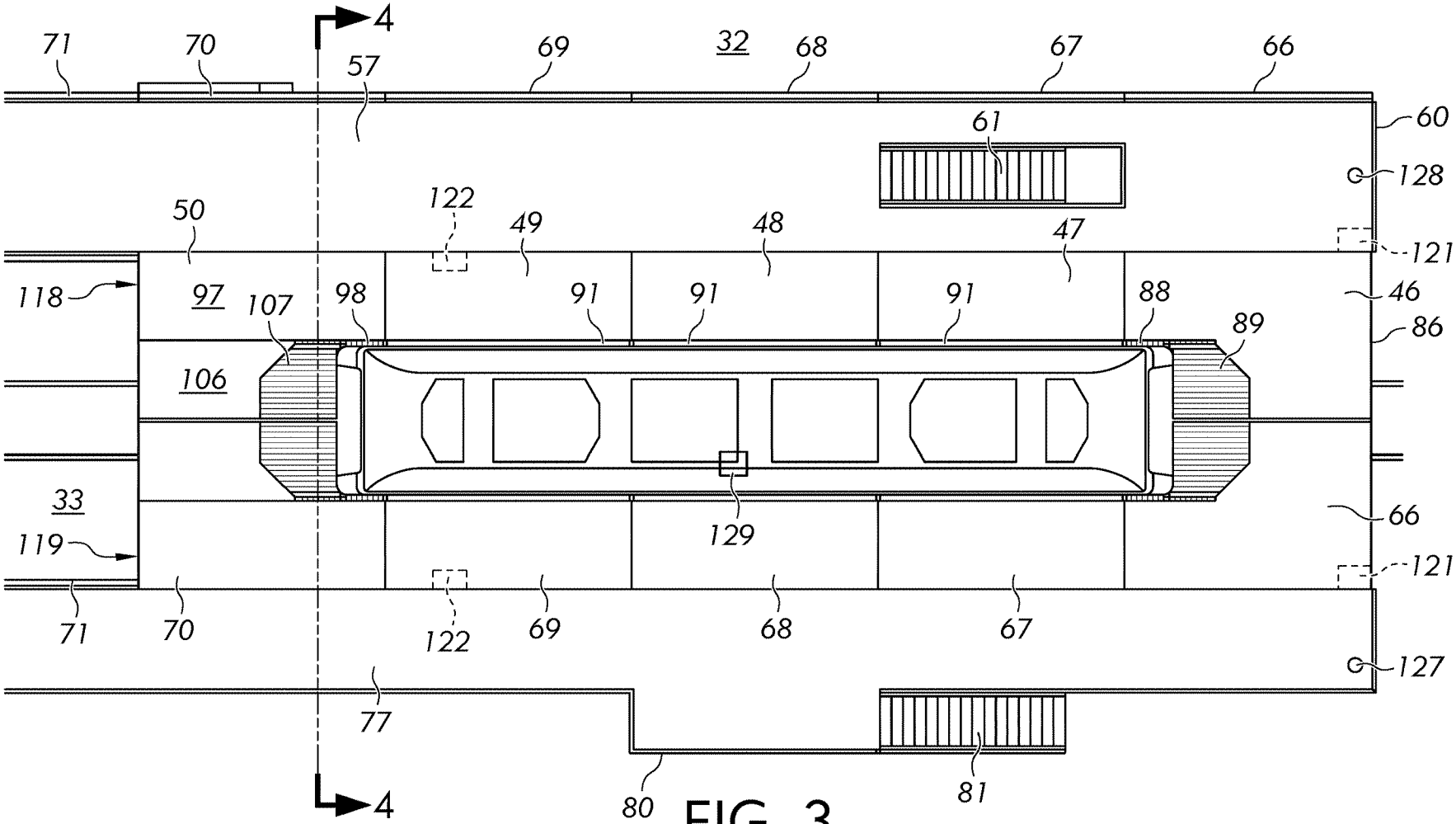
FIG. 3 shows a cutout of the maintenance device shown in FIG. 1 in a plan view.
Figure 4:
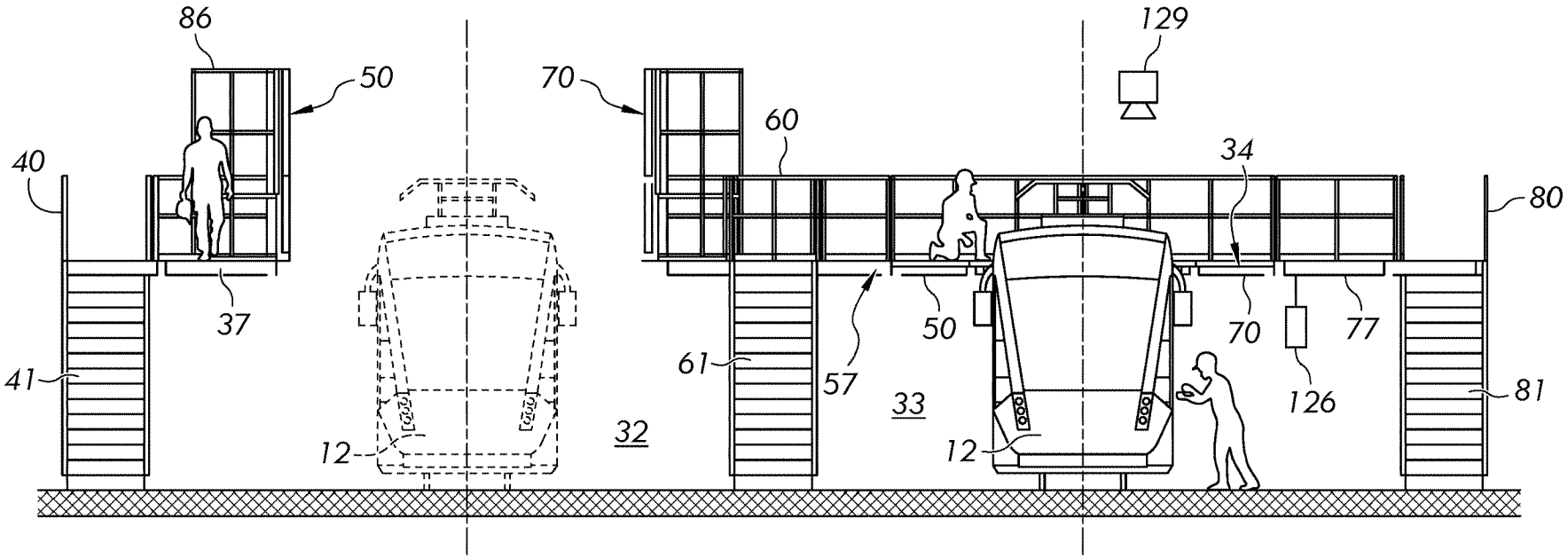
FIG. 4 shows a front view of a maintenance device according to the invention acc. to line IV-IV in FIG. 3.

A first variant of a work platform 31 according to the invention with two work areas 32 and 33 is illustrated in FIGS. 2 to 4. The elements of the work platform 31 in the case of the first work area 32, which are additionally described in detail in the following, are located in a position in which a vehicle 12 can drive in. In the case of the second work area 33, a vehicle 12 is already in the same and the elements of the work platform 31, which are additionally described in detail in the following, are located in a position in which it is possible to work on the roof area of the vehicle 12 without substantial restriction.

The work platform 31 comprises a platform 36 which has three first platform elements 37, 57 and 77 which form a work plane 34.

In a variant, which is not illustrated here, the first platform elements of a work platform can also be arranged offset with respect to one another or staggered, for example for taking account of local conditions and/or architectural wishes.

The first platform element 37, which is illustrated top left here, has a longitudinal extent with two mutually opposite long sides 38 and 39. Fixedly arranged guard rails 40 and two secured ascents 41 for workers are provided in each case at the end and along the outer long side 38 of the first platform element 37.

Along the long side 39 of the first platform element 37, a plurality of second platform elements (46 to 54, see the following) are provided, which can be transferred between two positions. In the first position illustrated here, these form a fall protection device, and in a second position, which is also described in detail below in connection with the work area 33, these at least to some extent form a continuation of the work plane 34.

In this exemplary embodiment, the two platform elements—starting from top right—a closing element 46, three identically constructed intermediate elements 47, 48 and 49, an intermediate closing element 50, an intermediate element 51 with fall protection element 118, a further intermediate closing element 52, a further intermediate element 53 with fall protection element 118 and a further closing element 54, are in each case arranged in a pivotable manner.

The central first platform element 57 has a longitudinal extent with two mutually opposite long sides 58 and 59. Fixedly arranged guard rails 60 and two secured ascents 61 for the workers are provided in each case at the end. Fixedly arranged guard rails 62 are likewise advantageously provided along the openings for the ascents.

Along the long side 58 of the central first platform element 57, a plurality of second platform elements (66 to 74, see the following) are provided, which can likewise be transferred between two positions. In the first position illustrated here, these form a fall protection device, and in a second position, which is also described in detail below in connection with the work area 33, these at least to some extent form a continuation of the work plane 34.

The plurality of second platform elements 66 to 74 and the plurality of second platform elements 46 to 54 face one another and are essentially constructed in a mirror-image manner to the second platform elements 46 to 54 of the first platform element 37. Thus, the two platform elements—again starting from top right—a closing element 66, three identically constructed intermediate elements 67, 68 and 69, an intermediate closing element 70, an intermediate element 71 with fall protection element 119, a further intermediate closing element 72, a further intermediate element 73 with fall protection element 119 and a further closing element 74, are in each case arranged in a pivotable manner.

A plurality of second platform elements (46 to 54, in each case constructed identically to the second platform elements with the same reference numbers on the upper first platform element 37) are provided along the long side 59 of the central first platform element 57, which second platform elements can be transferred between two positions. In the positions illustrated here, the second platform elements 46 to 50 form a continuation of the work plane 34, wherein the second platform elements 51 to 54 still form a fall protection device.

The first platform element 77 illustrated here at bottom right is essentially constructed in a mirror-image manner to the first platform element 37 illustrated top left. Thus, the first platform element 77 also has a longitudinal extent with two mutually opposite long sides 78 and 79. Fixedly arranged guard rails 80 and two secured ascents 81 for workers are provided in each case at the end and along the outer long side 79 of the first platform element 77.

A plurality of second platform elements (66 to 74, in each case constructed identically to the second platform elements with the same reference numbers on the central first platform element 57) are provided along the long side 78 of the first platform element 77, which second platform elements can be transferred between two positions. In the positions illustrated here, the second platform elements 66 to 70 form a continuation of the work plane 34, wherein the second platform elements 71 to 74 still form a fall protection device.

The following embodiments in connection with the closing element 46 are also valid analogously or correspondingly for the other closing elements 54, 66 or 74. The closing element 46 has on its upper side a guard rail section as a fall protection element 86, which is arranged in a pivotable manner and which in the first position rests on the upper side of the closing element 46. In the second position, the fall protection element 86 closes the work platform 31 in this region. A first distance bridging device 88 and a second distance bridging device 89 are provided on the underside of the closing element 46.

The following embodiments in connection with the intermediate element 47 are also valid analogously or correspondingly for the other intermediate elements 48, 49 or 67, 68, 69. A distance bridging device 91 is provided on the underside of the intermediate element 47.

In the following, the aforementioned distance bridging devices are also described in detail in connection with the intermediate closing elements 50, 52 or 70, 72.

Figure 5:
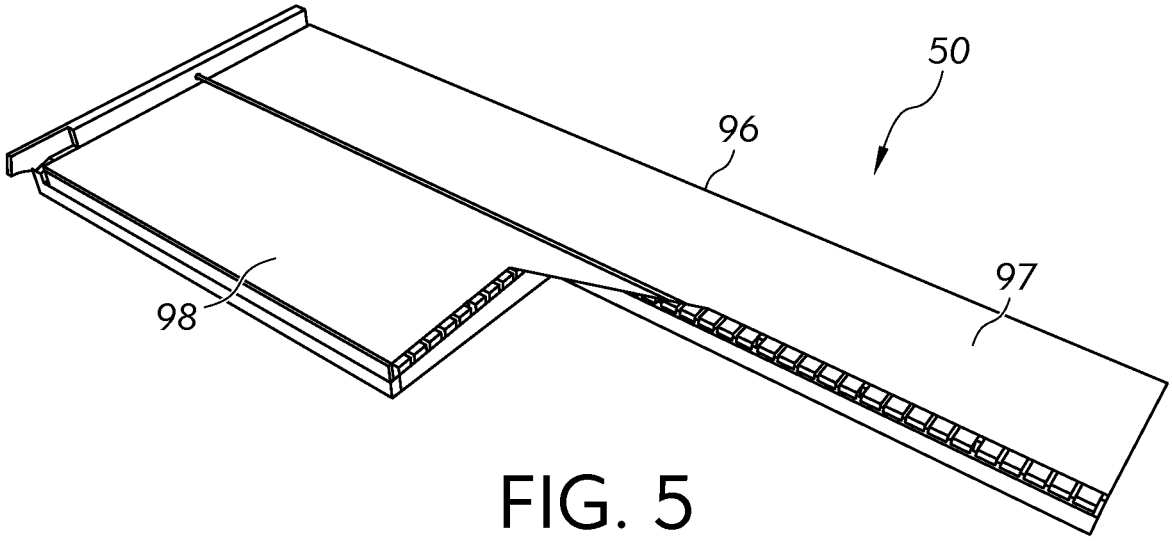
FIG. 5 shows a closing element in a perspective plan view.

The following embodiments (see also FIGS. 5 and 6) in connection with the intermediate closing element 50 are also valid analogously or correspondingly for the other intermediate closing elements 52 or 70, 72. The intermediate closing element 50 has an L-shaped basic structure in the plan view, wherein the longer side 96 of the intermediate closing element 50 is arranged in a pivotable manner on the first platform element 37. The intermediate closing element 50 is additionally constructed in a multipart manner and therefore has a first platform element part 97 and a front element 106, which is connected to the same in a pivotable manner. On the underside of the first platform element part 97 in the region of the free end thereof, a first distance bridging device 98 is provided for bridging a gap between the vehicle and the first platform element part 97.

On the underside of the front element 106 in the region of the free end thereof, a further distance bridging device 107 is provided for bridging a gap between the front-side or the rear-side end of the vehicle 12 and the front element 106.

Figure 6:
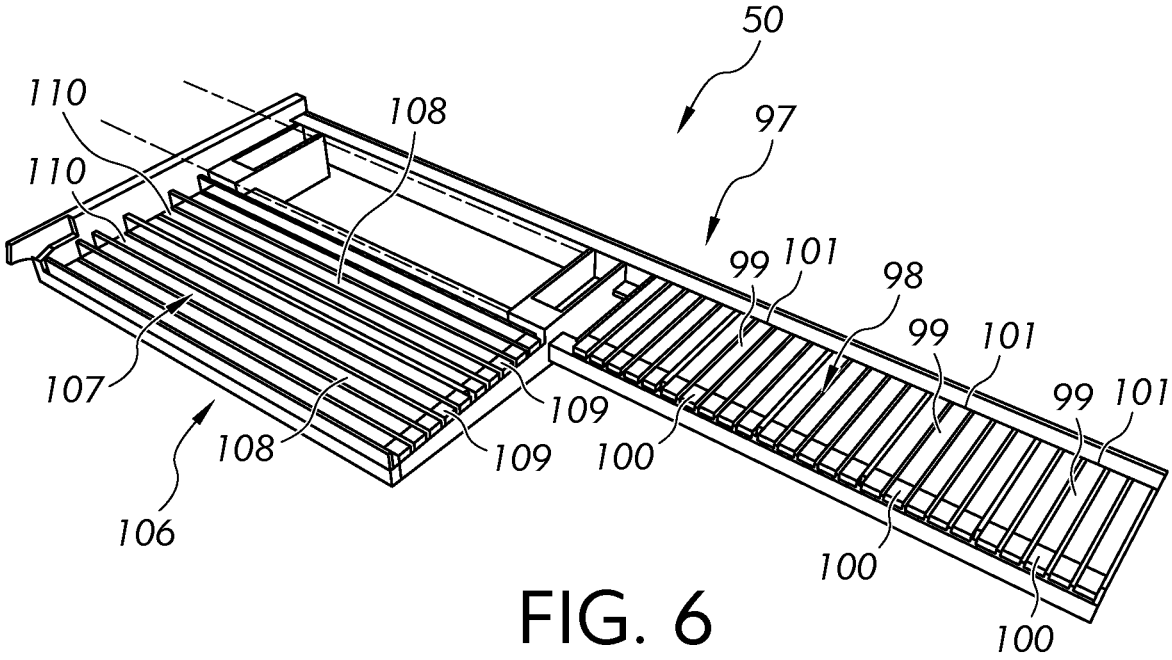
FIG. 6 shows the closing element shown in FIG. 5 without a cover.

The distance bridging devices 88, 91, 98 and 116 are constructed in the same way here, therefore the following embodiments for the distance bridging device 98 are correspondingly also valid for the distance bridging devices 88, 91 and 116. As can be seen in FIG. 6, the distance bridging device 98 comprises a plurality of adjacently arranged spacer elements 99, which are displaceable relatively to one another and which are spring-loaded by means of a spring element 101. A compression section 100, which can be deformed under pressure, is provided at the free end of the spacer elements 99.

The further distance bridging devices 89 and 107 are constructed in the same way here, therefore the following embodiments for the distance bridging device 107 are correspondingly also valid for the distance bridging device 89. The further distance bridging device 107 likewise comprises a plurality of adjacently arranged spacer elements 108, which are displaceable relatively to one another and which are spring-loaded by means of a spring element 110. A compression section 109, which can be deformed under pressure, is provided at the free end of the spacer elements 108.

The spacer elements 99 or 108 are displaced in a controlled manner for example individually or in a grouped manner in a group of a plurality of, e.g. four to six, spacer elements 99 or 108, between a park position and a distance bridging position. The control or the corresponding mechanism in this case is advantageously constructed in such a manner that a spacer element 99 or 108 is no longer moved further in the event of contact with the outer side of the vehicle 12, but the other spacer elements 99 or 108 not yet located in contact with the outer side of the vehicle 12 are still displaceable.

The following embodiments in connection with the intermediate element 51 are also valid analogously or correspondingly for the other intermediate elements 53 or 71, 73. A distance bridging device 116 and a fall protection element 118, which is arranged in a pivotable manner and can be transferred from a storage position to a safety position, are provided on the underside of the intermediate element 51. In the safety position, the fall protection element 118 allows an end-face closure of a sub-region of the work platform (see FIGS. 2 and 3).

The arrangement and design of the second platform elements 46 to 54 and 66 to 74 shown and described here relate to the configuration of the work platform 31 shown. For example, the second platform elements may comprise more or fewer intermediate elements or intermediate closing elements. The closing elements 46 and 54 or 66 and 74 shown are advantageously, but not absolutely necessarily, always present as start and end element.

A position detection device, which comprises e.g. a plurality of light curtains 121, 122, is provided for detecting the position of a vehicle 12 inside the accommodating region 33.

Furthermore, a positioning device 126 is provided for positioning the vehicle 12 along the work platform 31, which positioning device displays to the driver the correct position of the vehicle 12.

A plurality of rotary scanners 127, 128 are provided on the work area 34 of the work platform 31 as a work plane safety device for detecting objects and people on the work plane 34. With respect to the figures, a thermal imaging camera 129 is provided above the work area 34 of the work platform 31 for thermal monitoring of the roof area of the vehicle 12 and the work area 34 of the work platform 31.

For the driving in of a vehicle 12 into the corresponding work area, the second platform elements 46 to 54 and 66 to 74 are located in the first position, as illustrated for the work area 32. As soon as the vehicle 12 is correctly positioned, the corresponding second platform elements 46 to 50 and 66 to 70 are transferred to the second position, preferably in a controlled manner and independently of one another.

In the case of the intermediate closing element 50, to this end, first the front element 106 is pivoted out, so that the same in the second position of the intermediate closing element 50 likewise forms a continuation of the work plane 34.

Subsequently, all distance bridging devices 88, 89, 91, 98, 107 and 116 of the second platform elements 46 to 54 and 66 to 74 are moved forwards until the gap between the free end of the corresponding second platform elements 46 to 54 and 66 to 74 and the outer side of the vehicle 12 is closed or at least partially bridged.

Figure 7:
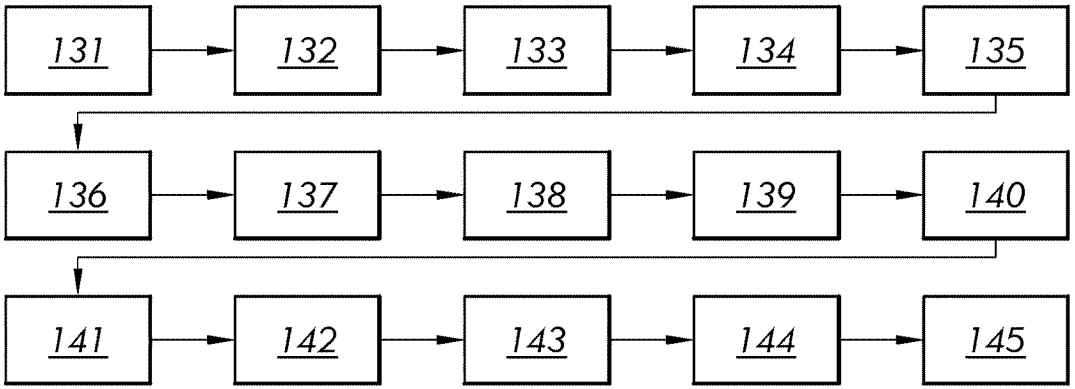
FIG. 7 shows a flow chart of the sequence for operating a maintenance device according to the invention.

The mode of operation of a work platform 31 is described in detail in the following on the basis of the flow chart according to FIG. 7.

In step 131, the vehicle 12 waits outside the maintenance device 11. The top power rail 16 is current-carrying (live) and pivoted down. The second platform elements 46 to 54 and 66 to 74 are located in the first position (are folded upwards). The first platform elements 37, 57 or 77 constitute a protected area for the workers, which means the same can safely be walked on.

In step 132, the vehicle 12 drives in. During the passage through the first light barrier 121 (drive-in side), horizontal light curtains of the work platform 31 come on.

In step 133, the vehicle 12 is positioned correctly by means of the positioning device 126, which has an optical display here. On the work platform 31, warning lights, e.g. rotating warning lights, are put into operation to promote awareness of the workers. The final positioning takes place by means of an automatic length detection in the form of horizontal light curtains 121, 122 placed on both sides.

In step 134, the top power rail 16 is earthed and subsequently pivoted upwards.

In step 135, the second platform elements 46 to 54 and 66 to 74, which are located along the positioned vehicle 12, are transferred into the second position (are folded down). The other second platform elements 46 to 54 and 66 to 74 remain in the first position and therefore still form a fall protection device. The vehicle 12 is still not yet accessible.

In step 136, the distance bridging devices 88, 89, 91, 98, 107 and 116 of the second platform elements 46 to 54 and 66 to 74 located in the second position are advanced until the gap between the free ends of the second platform elements 46 to 54 and 66 to 74 and the outer side of the vehicle 12 is bridged at least in certain areas. A gap which may remain advantageously does not exceed the size of 12 cm. Furthermore, for safety reasons, in this step 136, only the region of the first platform elements 37, 57 or 77 can still be walked on.

In step 136, the fall protection elements 86 and if required also the fall protection elements 118 and 119 are additionally pivoted into the safety position.

In step 137, the warning lights are then switched off, which signals to the workers that the work plane 34 of the work platform 31 is then accessible without restriction for maintenance work on the vehicle 12.

In step 138, the overhead travelling crane 17 can be put into operation to support the servicing or maintenance work.

In step 139, the maintenance work is completed. The overhead travelling crane 17 is guided into its park position and advantageously secured in the same. In addition, the position of the overhead travelling crane 17 is monitored using suitable sensors. The workers together with all mobile objects leave the work area of the second platform elements 46 to 54 and 66 to 74.

In step 140, the warning lights are put into operation again. Subsequently, a worker can start the process for transferring the second platform elements 46 to 54 and 66 to 74 from the second position to the first position, preferably using a security element, such as a badge. The work areas of the second platform elements 46 to 54 and 66 to 74 are scanned using rotary scanners 127 and 128 and/or a thermal imaging camera 129, in order to check that neither people nor objects are located in these work areas.

If the check using the rotary scanners 127 and 128 and/or the thermal imaging camera 129 shows that neither people nor objects are located there, the distance bridging devices 88, 89, 91, 98, 107 and 116 are retracted in step 141. Likewise, light curtains are put into operation, which monitor the transition between the first platform elements and the second platform elements 46 to 54 and 66 to 74. In the event of overstepping by a person, an acoustic warning signal is triggered and the retraction of the distance bridging devices 88, 89, 91, 98, 107 and 116 is stopped.

In step 141, the fall protection elements 86 and if required also the fall protection elements 118 and 119 are additionally pivoted into the storage position.

After the retraction of the distance bridging devices 88, 89, 91, 98, 107 and 116, in step 142, the second platform elements 46 to 54 and 66 to 74, which are located in the second position, are transferred to the first position or pivoted upwards. Prior to the transfer process, a warning is triggered, for example a relatively long acoustic signal.

As soon as all second platform elements 46 to 54 and 66 to 74 are located in the first position, in step 143, the corresponding top power rail 16 is pivoted down and thereafter voltage is applied. The warning lights are then switched off.

Then, the maintained vehicle 12 can leave the maintenance system 11 (step 144).

In an optional step, the corresponding top power rail 16 can be folded upwards anew, so that the overhead travelling crane 16 is available again, e.g. for clearing the work platform 31.

Figure 8:
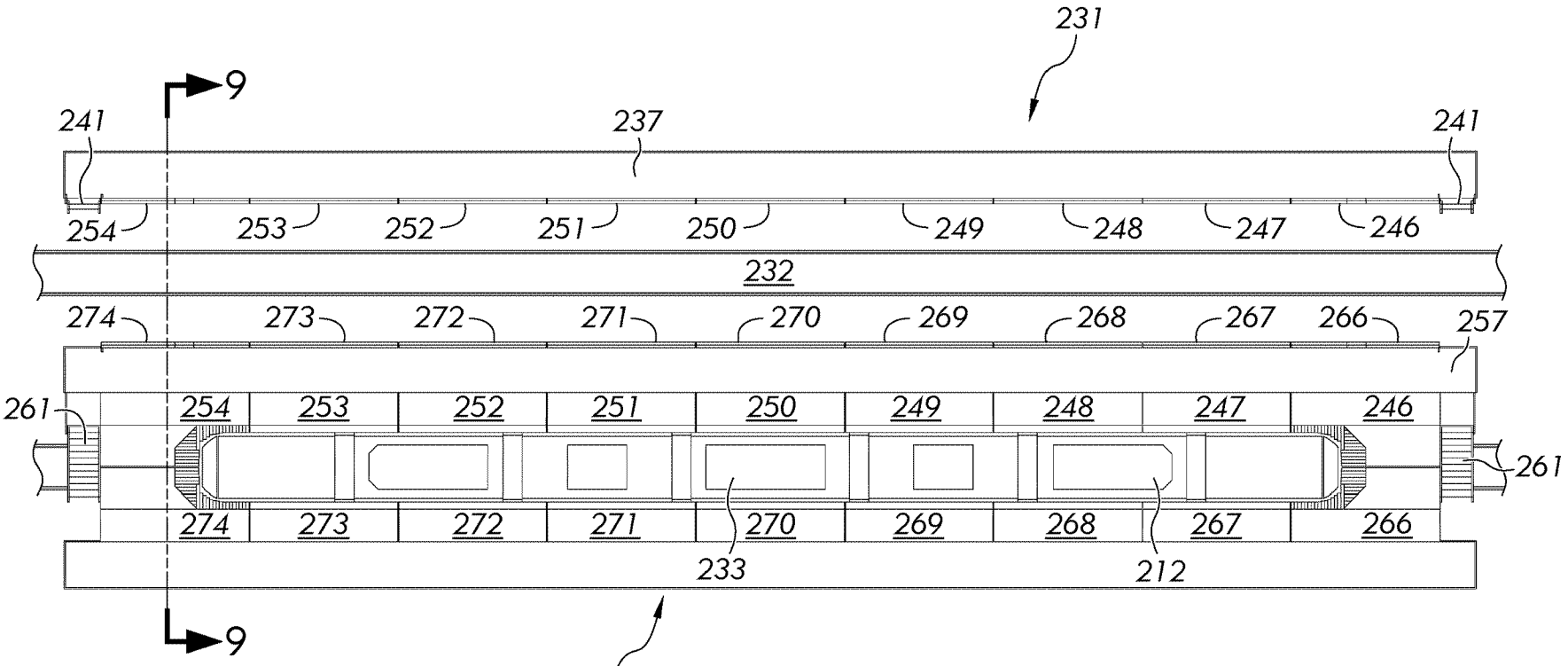
FIG. 8 shows the variant of the maintenance device according to FIG. 2 in a plan view.
Figure 9:
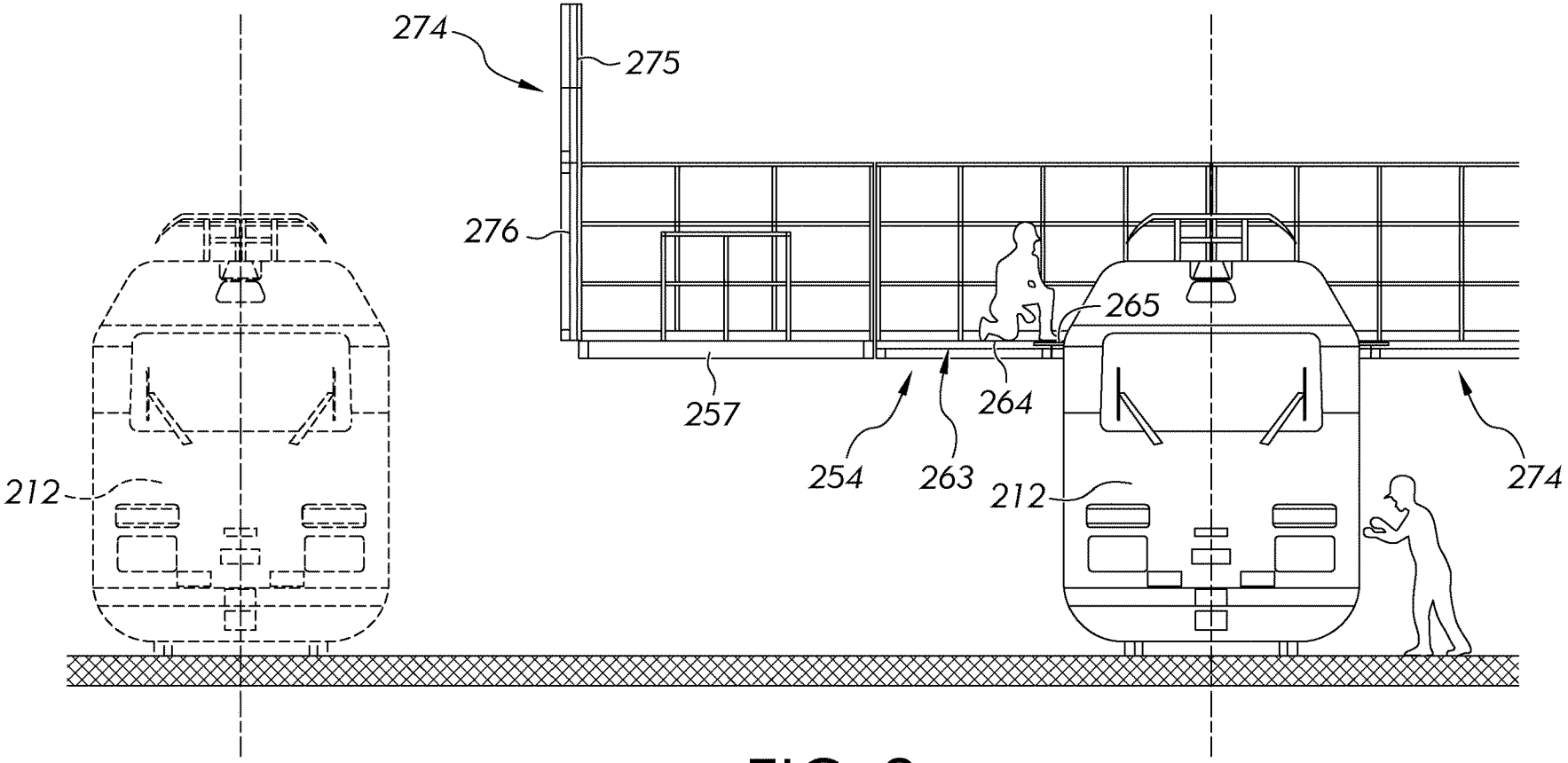
FIG. 9 shows a front view of the maintenance device according to the invention acc. to line IX-IX in FIG. 8.

The variant of a work platform 231 illustrated in FIGS. 8 and 9 corresponds in principle to the previously described work platform 31, wherein the same is however designed for vehicles 212 which are operated using high-voltage current. Comparable elements of the work platform 31 have a reference number which is increased by 200.

The second platform elements 246 to 254 and the second platform elements 266 to 274 of the platform 236 are located in their first position, so that the same form a fall protection device and protection from current-carrying components and a vehicle 212 can drive into the first work area 232. In the case of the second work area 233, a vehicle 212 is already in the same and the corresponding second platform elements 246 to 254 and also the second platform elements 266 to 274 are located in their second position, in which it is possible to work on the roof area of the vehicle 212.

The here above-described first platform element 237 in each case has a secured ascent 241 for the workers at the end-face end region, wherein these can be folded up for driving a vehicle 212 in or out. In the folded up position of the ascent 241, the first platform element 237 is not accessible.

The secured ascents 261 to the central first platform element 257 are located in the position in which the central first platform element 257 is accessible for the workers.

As high-voltage current is present here, the dimension of the second platform elements 246 to 254 and 266 to 274 in the first position above the corresponding first platform element 237, 257 or 277 must be at least 1.80 m according to the applicable standards. Among other things, in order to keep the overall dimensions of the maintenance device as small as possible in terms of the width, the distance between a first platform element 237, 257 or 277 and a vehicle 212 located in the work platform 231 is smaller than this dimension. Accordingly, the second platform elements 246 to 254 and 266 to 274 are constructed in a multipart manner.

In FIG. 9, the second platform element 274 shown on the left is illustrated in the first position and has a first platform element part 275 and a second platform element part 276. The first platform element part 275 is arranged in a pivotable manner on the second platform element part 276. In the first position, the first platform element part 275 lies as an extension of the second platform element part 276.

The second platform element 254 illustrated in FIG. 9 is shown in its second position and likewise constructed in a multipart manner. The first platform element part 263 is pivoted with respect to the second platform element part 264, so that this second platform element 254 is folded up. The second platform element 254 is constructed in such a manner that the distance bridging device 265 can be advanced to close the remaining gap between the folded up second platform element 254 and the outer side of the vehicle 212. For example, corresponding recesses are provided for that.

Although the invention is illustrated and described in detail by means of the figures and the associated description, this illustration and this detailed description are to be understood illustratively and by way of example and not as limiting the invention. It is understood that persons skilled in the art may make changes and modifications without departing from the scope of the following claims. In particular, the invention likewise comprises embodiments having any combination of features which are mentioned or shown previously for various aspects and/or embodiments.

The invention likewise comprises individual features in the figures, even if they are shown there in connection with other features and/or are not mentioned previously. Furthermore, the expression "comprise" and derivatives thereof do not exclude other elements or steps. Likewise, the indefinite article "a" or "an" and derivatives thereof do not exclude a multiplicity. The functions of a plurality of features listed in the claims can be fulfilled by one unit. The terms "substantially", "somewhat", "approximately" and the like in connection with a property or a value in particular also define precisely the property or precisely the value. Reference numbers in the claims are not to be understood as limiting the scope of the claims.

REFERENCE LIST

11 Maintenance device
12 Vehicle

14 Work area
15 Inspection pit
16 Top power rail
17 Overhead travelling crane
21 Work platform
31 Work platform
32 Work area
33 Work area
34 Work plane
36 Platform
37 1st platform element
38 Long side of 37
39 Outer long side of 37
40 Guard rail
41 Ascent
46 Closing element
47 Intermediate element
48 Intermediate element
49 Intermediate element
50 Intermediate closing element
51 Intermediate element
52 Intermediate closing element
53 Intermediate element
54 Closing element
57 1st platform element
58 Long side of 57
59 Outer long side of 57
60 Guard rail
61 Ascent
62 Guard rail around 61
66 Closing element
67 Intermediate element
68 Intermediate element
69 Intermediate element
70 Intermediate closing element
71 Intermediate element
72 Intermediate closing element
73 Intermediate element
74 Closing element
77 1st platform element
78 Long side of 37
79 Outer long side of 37
80 Guard rail
81 Ascent
86 Fall protection element
88 1st distance bridging device
89 2nd distance bridging device
91 Distance bridging device
96 Longer side of 50
97 1st platform element part
98 1st distance bridging device
99 Spacer element
100 Compression section
101 Spring element
106 Front element
107 2nd distance bridging device
108 Spacer element
109 Compression section
110 Spring element
116 Distance bridging device
118 Fall protection element
119 Fall protection element
121 Light curtain
122 Light curtain
126 Positioning device
127 Rotary scanner
128 Rotary scanner
129 Thermal imaging camera
131-145 Method steps
212 Vehicle
231 Work platform
232 Work area
233 Work area
236 Platform
237 1st platform element
241 Ascent
246 Closing element
247 Intermediate element
248 Intermediate element
249 Intermediate element
250 Intermediate closing element
251 Intermediate element
252 Intermediate closing element
253 Intermediate element
254 Closing element
257 1st platform element
261 Ascent
263 1st platform element part of 254
264 2nd platform element part of 254
265 Distance bridging device
266 Closing element
267 Intermediate element
268 Intermediate element
269 Intermediate element
270 Intermediate closing element
271 Intermediate element
272 Intermediate closing element
273 Intermediate element
274 Closing element
275 1st platform element part of 274
276 2nd platform element part of 274
277 1st platform element

The invention claimed is:

1. A work platform for working on a roof area of a vehicle, particularly on a roof area of an electrified vehicle, comprising at least one platform, the at least one platform comprising:

at least one first platform element, which forms a work plane, and a longitudinal extent with two mutually opposite long sides, and at least one second platform element, which is arranged along at least one of the long sides of the at least one first platform element and can be transferred between two positions with respect to the at least one first platform element, the at least one second platform element comprising at least one free end, wherein in the region of the free end of the at least one second platform element at least one distance bridging device is provided for at least partial bridging of a distance between the free end of the at least one second platform element and the vehicle located in the work platform, wherein the at least one second platform element forms a fall protection device in a first position and a continuation of the work plane of the at least one first platform element in a second position.

2. The work platform according to claim 1, wherein the at least one second platform element is arranged in a pivotable manner on the at least one first platform element.

3. The work platform according to claim 1, wherein the at least one second platform element is constructed in a multipart manner, wherein one of the platform element parts can be transferred between two positions with respect to a different platform element part.

4. The work platform according to claim 1, wherein the at least one distance bridging device has a plurality of spacer elements, which can be moved parallel to one another.

5. The work platform according to claim 4, wherein the plurality of spacer elements can be transferred in a controllable manner separately from one another between a park position and a distance bridging position.

6. The work platform according to claim 1, wherein at least one compression section is provided at a free end of the at least one distance bridging device.

7. The work platform according to claim 1, wherein a plurality of second platform elements are provided along at least one long side of the at least one first platform element.

8. The work platform according to claim 7, wherein each of the second platform elements can be transferred between two positions independently of the other second platform elements.

9. The work platform according to claim 1, wherein at least two first platform elements are provided, which are spaced from one another with the formation of an accommodating region for accommodating the vehicle between the two first platform elements, wherein the second platform elements of the two first platform elements are respectively arranged on the long side of the same, which sides face one another.

10. The work platform according to claim 9, wherein the first platform element, has at least one second platform element respectively on both of its long sides between two accommodating regions for at least two vehicles, wherein each at least one second platform element on one long side of the first platform element can be transferred from the first position to the second position independently of the other at least one second platform element on the other long side of the first platform element.

11. The work platform according to claim 9, wherein at least two closing elements are provided as second platform elements on each first platform element, wherein the at least two closing elements are formed in the second position for end-face closure of the accommodating region.

12. The work platform according to claim 11, wherein at least one closing element of the at least two closing elements has a front element, which can be transferred from a park position to a work position.

13. The work platform according to claim 12, wherein the front element is arranged in a pivotable manner.

14. The work platform according to claim 11, wherein a further distance bridging device is provided on each of the at least two closing elements.

15. The work platform according to claim 9, wherein at least one fall protection element is arranged on at least one of the second platform elements, wherein the at least one fall protection element can be transferred from a storage position to a safety position.

16. The work platform according to claim 1, wherein a position detection device is provided for detecting the position of a vehicle in the work platform.

17. The work platform according to claim 1, wherein a positioning device for positioning the vehicle is provided along the work platform.

18. The work platform according to claim 1, wherein at least one work plane safety device is provided for detecting objects and people on the work plane.

19. The work platform according to claim 18, wherein the at least one work plane safety device comprises a scanner.

20. A maintenance device for working on roof areas of vehicles, comprising at least one work platform according to claim 1.

* * * * *